United States Patent [19]

Takeda et al.

[11] Patent Number: 4,647,185

[45] Date of Patent: Mar. 3, 1987

[54] DEVELOPER DETECTING DEVICE

[75] Inventors: Hiroaki Takeda; Masato Ishida, both of Kawasaki, Japan

[73] Assignee: Canon Kabushiki Kaisha, Tokyo, Japan

[21] Appl. No.: 704,902

[22] Filed: Feb. 22, 1985

Related U.S. Application Data

[63] Continuation of Ser. No. 432,758, Oct. 4, 1982, abandoned.

[30] Foreign Application Priority Data

Oct. 23, 1981 [JP] Japan ..... 56-168846
Oct. 23, 1981 [JP] Japan ..... 56-168847

[51] Int. Cl.[4] ..... G03G 15/08

[52] U.S. Cl. ..... 355/14 D; 355/3 DD; 118/689

[58] Field of Search ..... 355/3 DD, 14 D; 118/689, 690, 691

[56] References Cited

U.S. PATENT DOCUMENTS

| | | | |
|---|---|---|---|
| 4,200,665 | 4/1980 | Suzuki et al. | 355/14 D |
| 4,226,525 | 10/1980 | Sakamoto et al. | 355/14 D |
| 4,240,375 | 12/1980 | Terashima | 355/3 DD |
| 4,241,696 | 12/1980 | Huzii | 355/3 DD |
| 4,270,487 | 6/1981 | Terashima et al. | 355/3 DD |
| 4,332,467 | 6/1982 | Kimura et al. | 355/14 D |
| 4,338,019 | 7/1982 | Terashima et al. | 355/14 D |
| 4,405,226 | 9/1983 | Kimura et al. | 355/14 D |
| 4,423,948 | 1/1984 | Kimura et al. | 355/14 D |

*Primary Examiner*—R. L. Moses
*Attorney, Agent, or Firm*—Fitzpatrick, Cella, Harper & Scinto

[57] ABSTRACT

A developer detecting device includes a developing unit for developing latent images with developer, a stirring unit for stirring the developer, a detector for detecting, during a stirring period, a decrease in the amount of developer and circuitry which outputs a signal detection only after a detection by the detector for at least one stirring period.

14 Claims, 5 Drawing Figures

DEVELOPER DETECTING DEVICE

This application is a continuation of application Ser. No. 432,758 filed Oct. 4, 1982 now abandoned.

BACKGROUND OF THE INVENTION

1. Field of the Invention

This invention relates to a developer detecting device for detecting the condition of a developer which develops latent images.

2. Description of the Prior Art

In a copying apparatus wherein the latent image of an object to be copied is developed by the use of a developer and transferred to recording paper, judgment as to the deficiency or the like of the developer relative to a predetermined amount has been made directly in correspondence with the output of a toner sensor for determining whether the amount of developer has reached the predetermined amount and no special processing has been carried out.

However, as the amount of developer decreases and approaches a threshold level, the output of the toner sensor becomes unstable and, with the conventional system, there has occurred an inconvenience that in spite of the fact that a predetermined amount of developer is actually present, a deficiency in the amount of developer is nevertheless judged and displayed. Particularly, in a copying apparatus provided with a periodically moving developer stirring rod, when the amount of developer is small, the developer moves with the movement of the stirring rod and the amount of developer in the region in which the toner sensor is disposed increases or decreases, and this has led to the inconvenience of a periodic display of deficiency of the developer.

Also, in a copying apparatus having a toner sensor using a piezoelectric vibrator, in some cases, the toner sensor has malfunctioned due to temporary vibration of the machine and a deficiency of developer has been judged even when there is a sufficient amount of developer, and such judged deficiency of developer has been displayed.

SUMMARY OF THE INVENTION

The present invention has been made in view of the above-noted points and an object thereof is to provide a developer detecting device for reliably detecting the condition of a developer which develops latent images.

Another object of the present invention is to provide a developer detecting device for detecting a reduction in the amount of a developer which develops latent images.

Still another object of the present invention is to provide a developer detecting device in which a signal is put out after a first time when a change in condition of developer toward one state is detected and the signal is stopped after a second time when a change in condition of developer toward the other state is detected.

Still another object of the present invention is to provide a developer detecting device in which a signal is put out after at least one stirring period of developer when any change in the condition of the developer is detected.

Other and further objects, features and advantages of the invention will appear more fully from the following detailed description taken in conjunction with the accompanying drawings.

BRIEF DESCRIPTION OF THE DRAWINGS

FIG. 2-1 is a block diagram showing the system construction of the entire copying apparatus.

FIG. 2-2 discloses the CPU 10 of FIG. 2-1.

DESCRIPTION OF THE PREFERRED EMBODIMENT

The invention will hereinafter be described in detail with reference to the drawings.

Figure 1:
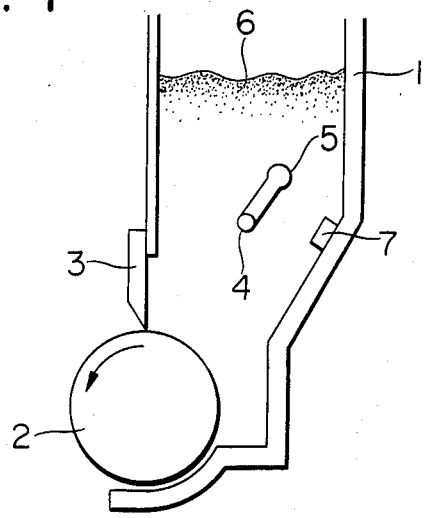
FIG. 1 is a schematic cross-sectional view of a developing device having developer therein and contained in a copying apparatus.

FIG. 1 is a schematic cross-sectional view of a developing device contained in a copying apparatus and having developer therein. In FIG. 1, reference numeral 1 designates a developing device hopper and reference numeral 2 denotes a developing sleeve rotatably provided in the lower end portion of the developing device hopper 1. The end of a blade 3 supported by the developing device hopper 1 bears against the developing sleeve 2. A stirring rod 5 rotatably supported by a stirring rod driving shaft 4 is provided in the developing device hopper 1, and developer 6 filling the developing device hopper 1 is stirred by the rotation of the stirring rod 5. Designated by 7 is a toner sensor which is level determining means for determining whether the amount of developer has reached a predetermined amount. If, for example, the developer is a magnetic toner, the toner sensor may be designed to detect the magnetic permeability. The stirring is accomplished with rotation being transmitted from the drive system to the stirring rod driving shaft 4 and the stirring rod 5 the developer is stirred by the stirring rod 5 being rotated substantially at a constant speed. In the present embodiment, the period of the stirring is about 30 seconds.

Figures 1, 2:
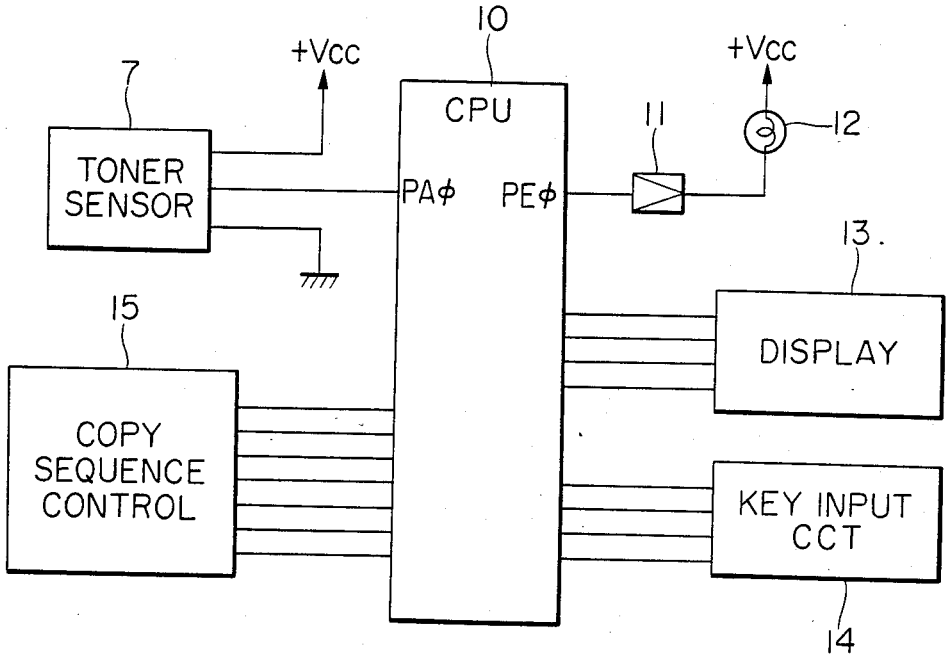
Figure 2:
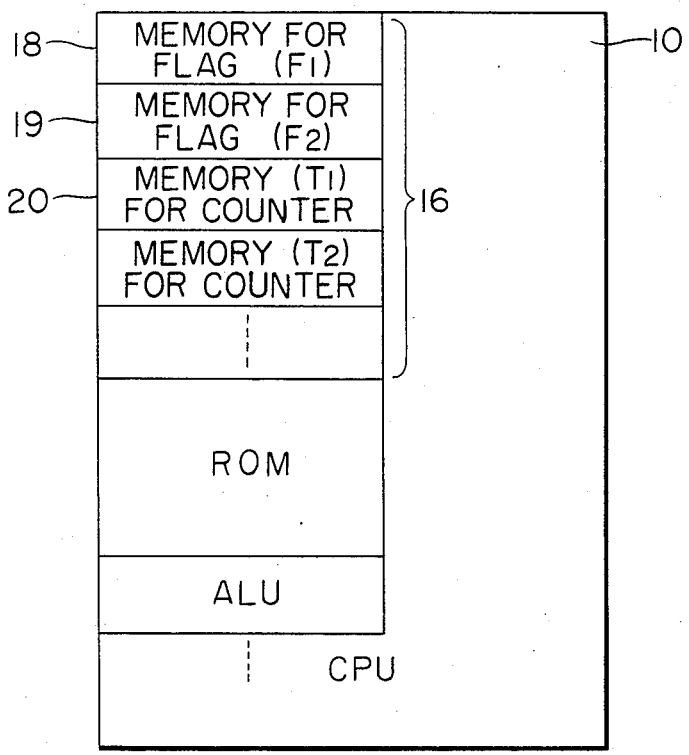

FIG. 2-1 is a block diagram showing the system construction of the entire copying apparatus. Designated by 10 is a central operation processing unit (hereinafter referred to as the CPU) for monitoring the operation of the entire system. The aforementioned toner sensor 7 is connected to the input port PAϕ of the CPU and a display lamp 12 for displaying the current state of the developer relative to a predetermined amount, for example, the deficiency of the developer, is connected to the output port PEϕ of the CPU through a drive circuit 11. In addition, a copy number, no-paper lamp and jam lamp display circuit 13 is connected to the CPU 10. A key input circuit 14 and a copy sequence control circuit 15 are further connected to the CPU 10, so that a predetermined copy sequence is effected in response to a key input. These operations do not have a direct relation with the present invention and are well known and therefore need not be described herein.

The toner sensor 7 is designed to put a logic level "1" when it detects that the amount of developer is less than a predetermined amount and to put out a logic level "0" when it detects that the amount of developer has reached the predetermined amount. The CPU 10 renders the logic level of the output port PEϕ "1" when the logic level "1" of the input sensor 7 of the input port PAϕ, indicative of the fact that the amount of developer is less than the predetermined amount continues for a time longer than the 30 second stirring period of the stirring rod 5, for example, for $T_1=40$ seconds, and renders the logic level of the output port PEϕ "0" when the logic level "0" of the input sensor 7 of the port PEϕ, indicative of the fact that the amount of developer has reached the predetermined amount, continues, for example, for $T_2=1$ second. Accordingly, when the output port PEϕ of the CPU 10 is at "1", the drive circuit 11 is operated to turn on the developer deficiency display lamp 12 and, when the output port PEϕ is at "0", the drive circuit 11 is not operated and the developer deficiency display lamp 12 is not turned on.

FIG. 2-2 discloses the CPU 10 of FIG. 2-1. In FIG. 2-2, reference numeral 16 designates the RAM portion in the CPU 10. Reference numeral 17 denotes a memory for flag (F1), reference numeral 18 designates a memory for flag (F2), and reference numerals 19 and 20 denote memories for counter (CNT). In ROM having memories for PAϕ, PEϕ and others, there is stored the program procedure as shown in the flow chart of FIG. 3. ALU decreases the count number of the counter (CNT) one by one and each time, supplies the value thereof to a memory 19 or 20 for counter (CNT).

Figure 3:
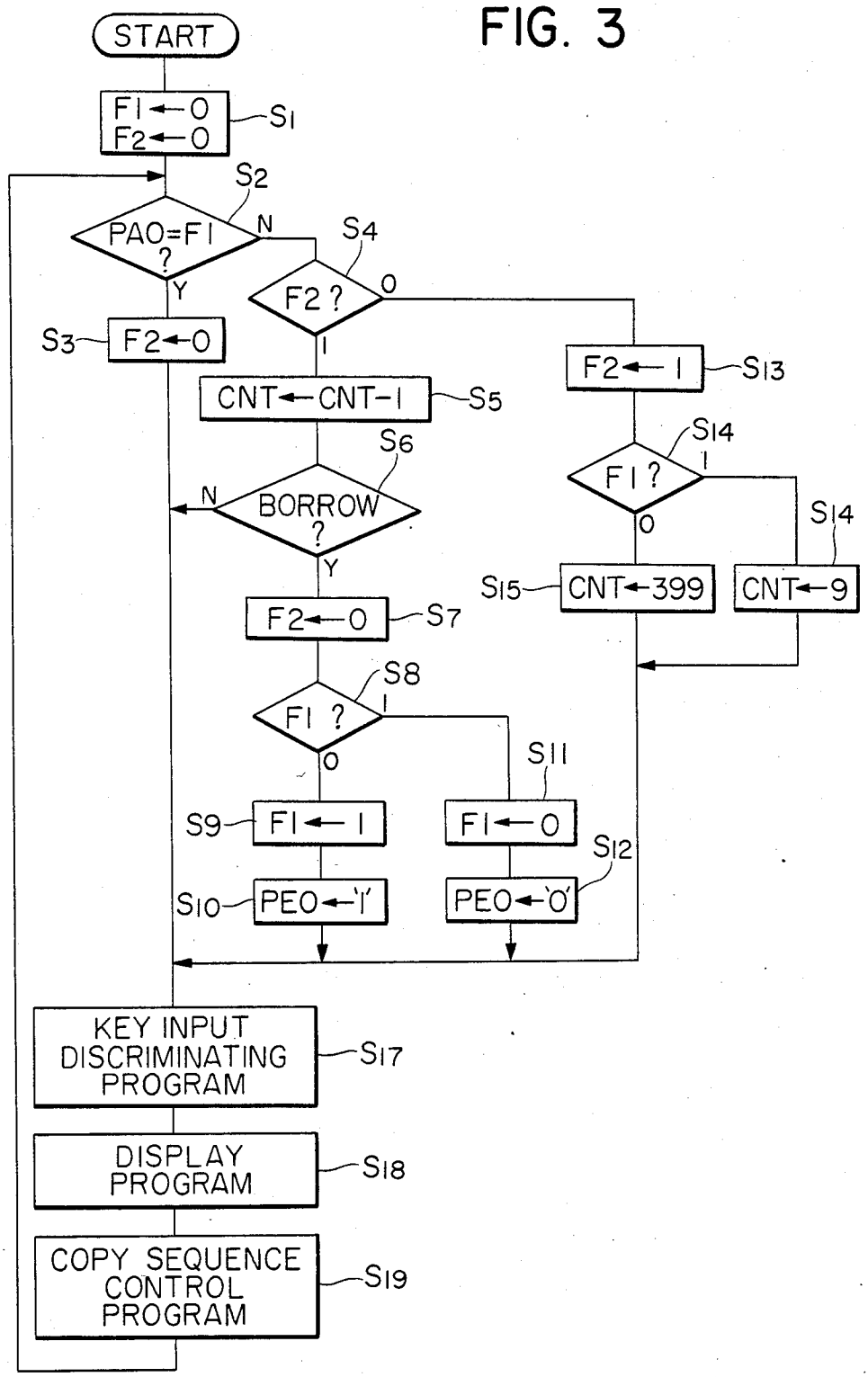
FIG. 3 is an example of the developer amount monitor program flow chart included as the processing content of the CPU 10.

FIG. 3 shows an example of the flow chart of the developer amount monitor program included as the processing content of the CPU 10. In FIG. 3, F1 is a flag representative of whether judgment has been made that the amount of developer has reached the predetermined amount or that the amount of developer is less than the predetermined amount, and when the amount of developer has reached the predetermined amount, "ϕ" is set and "ϕ" is stored in the memory 17 for flag (F1) shown in FIG. 2-2. When the amount of developer is less than the predetermined amount, "1" is set in F1 and "1" is stored in the memory 17 for flag (F1), F2 is a flag for judging whether the counter CNT for counting the aforementioned $T_1$ (40 seconds) and $T_2$ (1 second) has been set, and in the case of "1", the counter CNT is set and at this time, "1" is stored in the memory 18 for flag (F2) shown in FIG. 2-2. Also, the count number is decreased one by one by the ALU of FIG. 2-2 and each time, that count number is stored in the memory 19 or 20 for counter (CNT).

First, when the CPU 10 is initially reset, execution of the program is initiated from the start. The loop passing through a judgment block $S_2$ is programmed to make one round in 100 msec. When the program is initialed from the start, F1 is set to "ϕ" at step $S_1$ and, if the port PAϕ is set at ϕ, judgment YES is made in the judgment block $S_2$ and moreover, at this time, the counter CNT is not set and therefore, the program executes the steps $S_2 \rightarrow S_3 \rightarrow S_{17} \rightarrow S_{18} \rightarrow S_{19}$ which form a loop. That is, at step $S_{17}$, the presence or absence of the key input from the outside is judged and at step $S_{18}$, the display controls such as check-up of the number of copies, turn-on of the no-paper lamp based thereon and turn-on of the jam lamp based on the detection of paper jam are effected, and at step $S_{19}$, control of the ordinary copy sequence operation is effected. At this time, the display lamp 12 remains turned off. The key input judgment program of step $S_{17}$, the copy number check-up, no-paper lamp and jam lamp display program of step $S_{18}$ and the copy sequence control program are well known and therefore, the portion concerning the toner sensor will be described herein.

When an output indicative of the fact that the amount of developer is less than the predetermined amount is produced by the toner sensor 7, PAϕ assumes 1 as previously mentioned and therefore, judgment NO is made at judgment block $S_2$. Accordingly, the program shifts to judgment step $S_4$. At this time, the counter CNT is not set and F2="ϕ" and therefore, at step 13, F2 is made into "1" and the counter CNT is set. At step 14, the content of F1 is judged and F1 is now "ϕ" and therefore, at step 15, 399 is set in the counter CNT and the program proceeds to steps $S_{17} \rightarrow S_{18} \rightarrow S_{19} \rightarrow S_2$. If PAϕ is at "1" continuedly, the program proceeds to steps $S_2 \rightarrow S_4 \rightarrow S_5$ because F2 is already "1" and as previously described, the value of the CNT of the memory for counter (CNT) is decremented by the ALU of FIG. 2-2. By one decrementing operation, the CNT becomes 398 and at judgment block $S_6$, the presence or absence of the occurrence of borrow is confirmed. At this time, borrow does not occur and therefore, the processing procedure becomes $S_5 \rightarrow S_6 \rightarrow S_{17} \rightarrow S_{18} \rightarrow S_{19} \rightarrow S_2$. If PAϕ is at "1" continuedly, the loop of $S_2 \rightarrow S_4 \rightarrow S_5 \rightarrow S_6 \rightarrow S_{17} \rightarrow S_{18} \rightarrow S_{19}$ is likewise repeated 399 times. That is, if PAϕ is at "1" for 39.9 seconds, the occurrence of borrow is judged at judgment block $S_6$ and the program shifts to $S_6 \rightarrow S_7 \rightarrow S_8 \rightarrow S_9 \rightarrow S_{10}$ and PEϕ is set to "1" and therefore, the display lamp 12 is turned on to display that the amount of developer is less than the predetermined amount. If PAϕ becomes "ϕ" before said loop is completed 399 times, the program proceeds to $S_2 \rightarrow S_3 \rightarrow S_{17} \rightarrow S_{18} \rightarrow S_{19} \rightarrow S_2$ and it is neglected that PAϕ has become "1".

Assume that the amount of developer is less than the predetermined amount (F1="1") and the deficiency of the developer has been displayed by the display lamp 12. At this time, PAϕ is at "1" and therefore, the loop of $S_2 \rightarrow S_3 \rightarrow S_{17} \rightarrow S_{18} \rightarrow S_{19} \rightarrow S_2$ is repeatedly executed. If the copying operation is repeated in such condition, the desired copy is not obtained and therefore, supply of developer is effected on the basis of the display by the display lamp 12. When the amount of developer thus reaches the predetermined amount, PAϕ becomes "ϕ" and therefore, the program shifts to $S_2 \rightarrow S_4 \rightarrow S_{13} \rightarrow S_{14} \rightarrow S_{16}$ and the counter CNT is set to 9 at step 18. If PAϕ is "ϕ" continuedly, execution of the loop of $S_2 \rightarrow S_4 \rightarrow S_5 \rightarrow S_6 \rightarrow S_{17} \rightarrow S_{18} \rightarrow S_{19} \rightarrow S_2$ is repeated ten times, whereupon borrow occurs at step $S_6$ and therefore, the program shifts to $S_6 \rightarrow S_7 \rightarrow S_8 \rightarrow S_{11} \rightarrow S_{12}$ and at step $S_{12}$ "0" is set in PEϕ and thus, the display lamp 12 is turned off. If, at this time, PAϕ becomes "1" before said ten loops are completed, the program shifts fo $S_2 \rightarrow S_3 \rightarrow S_{17} \rightarrow S_{18} \rightarrow S_{19} \rightarrow S_2$ and it is neglected that "0" has been input to PAϕ.

Figure 4:
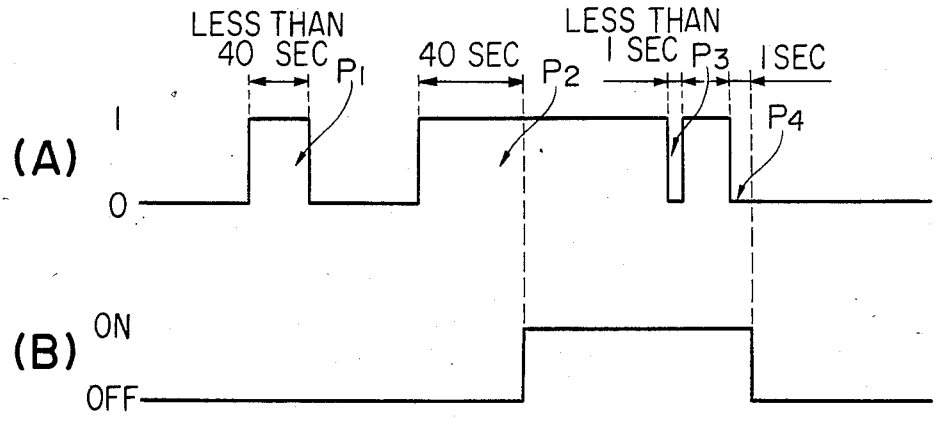
FIG. 4 is a time chart of a toner sensor output and a display lamp.

FIGS. 4(A) AND (B) show the time chart of the toner sensor output and the display lamp based on the previously described operation. In the OFF state of the display lamp, the condition does not change when the output condition in which the amount of developer is less than the predetermined amount only continues for less than 40 seconds as indicated by $P_1$ and, only when said output condition has continued for more than 40 seconds as indicated by $P_2$, it is judged that the amount of developer has become less than the predetermined amount, whereby the display lamp 12 is turned on the display the deficiency of the developer. Conversely, in the ON state of the display lamp 12, even if the output condition in which the amount of developer has exceeded the predetermined amount continues for less than 1 second as indicated by $P_3$, the condition does not change and, only when the output condition in which the amount of developer has exceeded the predetermined amount continues for 1 second as indicated by $P_4$, it is judged that the amount of developer has reached the predetermined amount, whereby the display lamp 12 is turned off.

Although $T_2=1$ second in the above-described embodiment, it is also possible that $T_2=0$ second so that the deficiency of the developer may be displayed when at least the output condition in which the amount of developer is less than the predetermined amount continues for a time longer than the stirring period.

It is apparent that broadly different embodiments can be constructed within the spirit and scope of the present invention and therefore, the present invention is not restricted to the specific embodiment illustrated herein but is defined by the appended claims.

What we claim is:

1. A developer detecting device comprising:
container means for containing a developer;
developing means for developing latent images with developer from said container means;
stirring means for periodically stirring the developer in said container means;
detecting means for detecting the amount of developer in said container means a plurality of times during at least one stirring period; and
decision means for deciding, in accordance with the number of detections by said detecting means, whether or not the amount of developer is below a predetermined amount.

2. A developer detecting device according to claim 1, wherein when all of the plurality of detections show that the amount of the developer is less than the predetermined amount, the decision means decides that the developer is below the predetermined amount.

3. A developer detecting device according to claim 1, wherein the developer is a toner.

4. A developer detecting device according to claim 1 further comprising means for displaying the amount of the developer.

5. A recording apparatus comprising:
container means for recording with a recording agent;
means for containing the recording agent; and
means for detecting and outputting a signal indicating the condition of the recording agent in said container means, wherein the criterion for outputting a signal indicating a decrease in the amount of the recording agent is different from the criterion for outputting a signal indicating a recovery in the amount of the recording agent, wherein the decrease criterion is that the amount of the recording agent is detected a plurality of times during a first predetermined time period and all of the plurality of detections shows a reduction in the amount of the recording agent to a level less than a predetermined level and the recovery criterion is that the amount of the recording agent is detected a plurality of times during a second predetermined time period and all of the plurality of detections show recovery in the amount of the recording agent to a level above the predetermined level.

6. A recording apparatus according to claim 5, wherein the first time period is longer than the second time period.

7. A recording apparatus according to claim 6, wherein the recording agent is developer.

8. A recording apparatus according to claim 7, further comprising means for periodically stirring the recording agent at a predetermined period shorter than the first time period.

9. A recording apparatus comprising:
means for recording with a recording agent;
container means for containing the recording agent;
means for detecting the amount of the recording agent in said container means a plurality of times during at least one stirring period; and
means for outputting a signal indicating the condition of the recording agent in accordance with the number of detections by said detecting means, wherein the criterion for outputting a signal indicating a decrease in the amount of the recording agent is different from the criterion for outputting a signal indicating a recovery in the amount of the recording agent.

10. A recording apparatus according to claim 9, wherein the recovery criterion is easier to satisfy than the decrease criterion.

11. A recording apparatus according to claim 9, wherein the decrease criterion is that the amount of the recording agent is detected a plurality of times during a first predetermined time period and all of the plurality of detections show a reduction in the amount of the recording agent to a level less than a predetermined level and the recovery criterion is that the amount of the recording agent is detected a plurality of times during a second predetermined time period and all of the plurality of detections show recovery in the amount of the recording agent to a level above the predetermined level.

12. A recording apparatus according to claim 11, wherein the first time period is longer than the second time period.

13. A recording apparatus according to claim 12, wherein the recording agent is developer.

14. A recording apparatus according to claim 13, further comprising means for periodically stirring the recording agent at a predetermined period shorter than the first time period.

* * * * *